US007139705B1

(12) United States Patent
Beerends et al.

(10) Patent No.: US 7,139,705 B1
(45) Date of Patent: Nov. 21, 2006

(54) DETERMINATION OF THE TIME RELATION BETWEEN SPEECH SIGNALS AFFECTED BY TIME WARPING

(75) Inventors: John Gerard Beerends, Hengstdijk (NL); Andries Pieter Hekstra, Terheijden (NL)

(73) Assignee: Koninklijke KPN N.V., Groningen (NL)

( * ) Notice: Subject to any disclaimer, the term of this patent is extended or adjusted under 35 U.S.C. 154(b) by 833 days.

(21) Appl. No.: 10/130,594

(22) PCT Filed: Nov. 13, 2000

(86) PCT No.: PCT/EP00/10948

§ 371 (c)(1),
(2), (4) Date: Aug. 28, 2002

(87) PCT Pub. No.: WO01/41127

PCT Pub. Date: Jun. 7, 2001

(30) Foreign Application Priority Data

Dec. 2, 1999 (EP) ..... 99204089

(51) Int. Cl.
*G10L 21/00* (2006.01)

(52) U.S. Cl. ..... 704/237; 704/500; 704/200

(58) Field of Classification Search ..... 704/200, 704/237, 500
See application file for complete search history.

(56) References Cited

U.S. PATENT DOCUMENTS 6,609,092 B1 * 8/2003 Ghitza et al. ..... 704/226
6,674,730 B1 * 1/2004 Moerder ..... 370/316

FOREIGN PATENT DOCUMENTS

EP 0 644 674 3/1995
EP 0 946 015 9/1999

OTHER PUBLICATIONS

S. Tallak, et al., "Time Delay Estimation For Objective Quality Evaluation of Low Bit-Rate Coded Speech with Noisy Channel Conditions", Proceedings of the Asilomar Conference, IEEE, pp. 1216-1219.

* cited by examiner

*Primary Examiner*—Daniel Abebe
(74) *Attorney, Agent, or Firm*—Michaelson & Associates; Peter L. Michaelson; Alberta A. Vitale

(57) ABSTRACT

A method of determining the time relation between an original or input speech signal (10) and an output speech signal (15) affected by time warping in a communications system, such as a VoIP (Voice over Internet Protocol) system. Wherein corresponding speech bursts (11, 12; 16, 17) of the input (10) and output speech signal (15) are located in accordance with a predefined signal property thereof. The corresponding speech bursts (11, 12; 16, 17) thus located and time aligned (10, 30) for the correction of continuous and discontinuous warping effects. A performance estimate is generated by comparing the time aligned input and output speech signals (10, 30) applying cross-correlation techniques and PSQM (Perceptual Speech Quality Measure) or PSQM+ (Enhanced Perceptual Speech Quality Measure) techniques.

23 Claims, 8 Drawing Sheets

10
11
12
20
21
22
13
23
24
13
t
35
37
38
39
40
36

15
16
17
25
26
27
18
19
28
29
t
35
37
39
40
36
38

30
16
17
13
t

DETERMINATION OF THE TIME RELATION BETWEEN SPEECH SIGNALS AFFECTED BY TIME WARPING

FIELD OF THE INVENTION

The present invention relates to speech analysis and, in particular, to the determination of the time relation between an original or input speech signal and an output speech signal affected by time warping in a communications system, among others as a preprocessing step for analysing speech quality.

BACKGROUND OF THE INVENTION

When transporting speech in packet switched communications systems, such as systems operating under ATM (Asynchronous Transfer Mode) or by Internet Protocol (IP) techniques, warping of the time scale occurs from different transportation or transmission delays of the different packets, and buffering. In practice, each speech burst may encounter an individual transmission delay.

For objectively measuring the speech quality of time warped speech signals, such as signals transmitted in VoIP (Voice over Internet Protocol) systems, by comparing corresponding speech bursts of the output speech signal and its original input speech signal, the time relation between the speech bursts has to be determined before a performance estimate of the output speech signal can be provided.

In the context of the present invention, the term "speech burst" has to be construed as an amount of speech delimited by periods of lower energy or loudness. For the purpose of the present invention, the term speech burst refers to a speech utterance either on a coarse or sentence level or on a fine or spurt level.

Applicants' International patent application WO 96/06496 (invented by Michael HOLLIER et al, titled Analysis Of Audio Quality and filed Aug. 17, 1995) discloses a method of analyzing speech quality of an output speech signal affected by time warping in a communications system. Continuous time dewarping is applied to the received output signal using transform or digital filtering techniques, to adapt the macro properties of each speech element, such as pitch and duration, for providing an estimated original input signal. The estimated original input signal and the actual output signal received are subjected to a comparison step for providing an estimate of the subjective audio perception quality.

In a VoIP system, for example, warping is a discontinuous phenomenon in that the signals are manipulated during periods of silence, to keep the manipulations essentially non-audible to the receiver (i.e. the person receiving the signals). Degradation of the speech signal by discontinuous warping cannot be accounted for by the method disclosed in Applicants' International patent application WO 96/06496 (Michael HOLLIER et al, entitled "Analysis Of Audio Quality" and filed Aug. 17, 1995).

SUMMARY OF THE INVENTION

It is an object of the present invention to provide a method for the determination of the time relation between speech signals taking into account degradation caused by both continuous and discontinuous time warping.

It is a further object of the present invention to provide a method of analysing speech quality of speech signals affected by both continuous and discontinuous time warping.

It is another object of the present invention to provide a device for the determination of the time relation between speech signals taking into account both continuous and discontinuous warping effects in the transmission or transportation of speech signals in a communications system.

It is a still further object of the present invention to provide a device for analysing speech quality taking into account both continuous and discontinuous warping effects of speech signals in a communications system, and a telecommunications system comprising such a device.

According to the invention, there is provided a method of determining the time relation between an original or input speech signal and an output speech signal affected by time warping in a communications system, such as a VoIP (Voice over Internet Protocol) system, by time aligning corresponding speech bursts of the output speech signal and its original or input speech signal, wherein corresponding speech bursts of the input and output speech signal are located in accordance with a predefined signal property thereof.

In the context of the present invention, time aligning is to be construed as a process for cancelling out variable time delay between the input and output speech signals.

By locating, in the method according to the invention, the individual speech bursts in both the input and output signal, warping effects can be effectively ruled out, such that, in accordance with a further embodiment of the method of the invention, by comparing the time aligned signals, a performance estimate for determining the speech quality of the system can be provided.

For a realistic analysis of the quality of the communications system, it is not always required nor advisable to correct for all the time delay encountered, in particular in those cases wherein the variability of the delay is not longer unaudible, but indeed disturbing. In such a case, the non-compensated delay can be used as a further performance estimate for determining the speech quality of the system.

Signal properties applicable for locating the speech bursts are, in accordance with the present invention, among others, signal amplitude, signal rise and/or decay times, zero crossings, average signal energy content, etc.

In a preferred embodiment of the invention, the predefined signal property is parameterised, comprising a first parameter representative of an average signal energy content of a speech burst compared to a threshold, and a second parameter representative of a time window duration during which the energy content is being measured.

For optimally finding a speech burst of the input and output speech signal, in accordance with a further embodiment of the invention, the threshold and the duration of the time window are varied, dependent on the average signal energy content measured.

That is, in accordance with the present invention, stop and/or start points of individual speech bursts are accurately determined by varying the first and second parameters while determining silence or essentially silence adjacent a respective speech burst, for example.

In the preferred embodiment of the method according to the invention, successive stop points of speech bursts are located on sentence level by performing the steps of:

a) setting the threshold to a first value and the time window to a first time duration, b) measuring the average signal energy content in a time window of the first time duration and comparing same to the threshold of the first value, c) repeating measuring of the average signal energy content and comparison to the threshold of the first value in an adjacent subsequent time window of the first time duration while the measured energy content is below the threshold of the first value, and if the measured energy content is above the threshold of the first value, marking the location of the time window of the first time duration as a start point of the respective speech burst, d) setting the threshold to a second value typically equal to the first value and the time window to a second time duration typically less than the first time duration if the measured energy content is above the threshold of the first value, e) measuring the average signal energy content in a time window of the second duration, essentially located subsequently adjacent the time window of the first duration resulting from step d), and comparing same to the threshold of the second value, f) repeating measuring of the average signal energy content and comparison to the threshold of the second value in an adjacent subsequent time window of the second time duration while the measured energy content is above the threshold of the second value, g) setting the threshold to a third value typically less than the second value and the time window to a third time duration typically equal to the second time duration if the measured energy content is below the threshold of the second value, h) measuring the average signal energy content in the time window of the third value essentially located at the time window of the second duration resulting from step g) and comparing same to the threshold of the third value, i) repeating measuring of the average signal energy content and comparison to the threshold of the third value in an adjacent preceding time window of the third duration while the measured energy content is below the threshold of the third value, j) determining a stop point of a speech burst from the location of the time window in step i) if the measured energy content is above the threshold of the third value, and k) repeating steps a)–j) until the end of the speech signal.

The above steps are applied to both the original or input signal and the distorted or output signal.

Starting from a global starting point for both the input and output signal of the communications or transmission system, the time window within which the average signal energy content is measured is initially set relatively wide, i.e. at a first time duration representing a relatively large window opening, typically in the range of 1 second. The threshold is set at a first value such that, if the measured energy content in the time window is above the threshold, a signal burst has been encountered, while in the case of silence the measured energy content will be below the threshold. In the latter case, the measurement has to be repeated in a next adjacent time window. The exact setting of the threshold depends also on the implementation of the average signal energy content measurement.

Once a speech burst has been encountered, which is marked as a start point of a respective speech burst, the parameter settings are changed to a smaller time window, i.e. a second time duration representing a window opening of typically in the range of 200 Ms. The threshold value is set to a second value, typically equal to the first value.

While the average signal energy content is above the present threshold, the stop point of the burst has not yet been encountered, and measurements have to be continued in a next adjacent time window. In the context of the present invention, the term "adjacent" has to be construed as including overlapping, up to 50% for example, and non-overlapping time windows.

As soon as the measured signal energy content drops below the threshold, the present time window will include silence or essentially silence (i.e. none or a very small signal strength) from beyond the stop point of the burst. The time window and the threshold are set such that a relatively large portion of silence will be included. Typically, the threshold settings are not changed compared to the first value.

For a more accurate location of the stop point of the speech burst the average signal energy content is measured from the present position of the time window, in backward direction towards the speech burst, having the time window set to a third time duration and the threshold at a third value. Typically, the third value of the threshold is about one-tenth of the second value in the previous step, while the time duration of the time window is left unchanged. With these settings, the stop point can be very accurately located for the typical speech bursts which tend to fade out.

It will be appreciated that with the duration of the time window left unchanged, not more than one step of one time window in backward direction has to be made. However, the third time duration of the time window may be set to a value less than the second time duration, which implies that in the backward direction several steps with such a shorter time window can be made.

From the stop point thus determined, the stop point of the next speech burst is located and so on, till the end of the respective speech signal. Assuming that the length of a particular speech burst is not affected by time warping, it is sufficient to limit the procedure to the location of stop points.

However, for measuring and/or compensating the time delays in a more exact manner, those skilled in the art will appreciate that the start points of the speech bursts can be determined with greater accuracy than disclosed above. In a further embodiment of the invention, successive start points of speech bursts can be determined by performing the steps of:

m) setting the threshold to a fourth value and the time window to a fourth time duration, n) measuring the average signal energy content in a time window of the fourth time duration and comparing same to the threshold of the fourth value, o) repeating the measuring of the average signal energy content and comparison to the threshold of the fourth value in an adjacent subsequent time window of the fourth time duration while the measured energy content is below the threshold of the fourth value, p) setting the threshold to a fifth value typically equal to the fourth value and the time window to a fifth time duration typically less than the fourth time duration if the measured energy content is above the threshold of the fourth value, q) measuring the average signal energy content in the time window of the fifth value essentially located subsequently adjacent the time window of the fourth duration resulting from step p) and comparing same to the threshold of the fifth value, r) repeating measuring of the average signal energy content and comparison to the threshold of the fifth value in an adjacent preceding time window of the fifth time duration while the measured energy content is above the threshold of the fifth value, s) setting the threshold to a sixth value typically less than the fifth value and the time window to a sixth time duration typically equal to the fifth time duration if the measured energy content is below the threshold of the fifth value, t) measuring the average signal energy content in the time window of the sixth value essentially located at the time window of the fifth duration resulting from step s) and comparing same to the threshold of the sixth value, u) repeating measuring of the average signal energy content and comparison to the threshold of the sixth value in an adjacent preceding time window of the sixth duration while the measured energy content is above the threshold of the sixth value, v) determining a start point of a speech burst from the location of the time window in step u) if the measured energy content is below the threshold of the sixth value, and w) repeating steps m)–v) each time from a stop point of a speech burst until the end of the speech signal.

Again, the start points are determined for both the original or input signal and the distorted or output signal.

It will be appreciated that part of the input and output signal between adjacent start and stop points may be interpreted as silence and which can be manipulated, i.e. shortened or lengthened, if required.

The settings of the fourth, fifth and sixth threshold and the fourth, fifth and sixth time duration may be equal to the settings of the first, second and third threshold values, and the first, second and third time durations, respectively.

By combining on the one hand the start points and on the other hand the stop points of the corresponding speech bursts of the input and output signals, in a yet further embodiment of the method according to the invention, time delays in the process itself can be accounted for, such that time delays between adjacent speech bursts can be even more accurately established and the distorted or affected output signal can be accurately corrected for any discontinuous time warping, thereby enhancing the reliability of a performance estimate.

In order to provide for an accurate performance estimate, the above procedure is repeated on spurt level, that is individual speech burst within the bursts on sentence level. To this end, typical parameter settings are a first time duration of the time window of 20 ms and a second and third time duration of 10 ms. The threshold values are set to higher values compared to the sentence level, in order to account for relatively steep signal edges at spurt level.

A performance estimate of the speech quality of the thus aligned, i.e. time dewarped, input and output speech signals can be provided using non-perceptive quality measures, such as disclosed in applicants' published International patent applications WO 96/28950 (John Gerard Beerends, entitled "Signal Quality Determining Device And Method", and filed Mar. 13, 1996) and Applicants' International patent application WO 96/28953 (John Gerard Beerends, entitled "Signal Quality Determining Device And Method" and filed Nov. 11, 1996), which are all herein incorporated by reference.

The invention further provides a device for determining the time relation between an original or input speech signal and an output speech signal affected by time warping in a communications system, such as a VoIP (Voice over Internet Protocol) system, comprising means for locating corresponding speech bursts of the input and output speech signal in accordance with a predefined signal property thereof, and means for time aligning the corresponding speech bursts.

In an embodiment of the device according to the invention, the means for locating the speech bursts comprises:

means for setting a threshold;

means for setting a time window duration;

means for positioning the time window;

means for measuring average signal energy content in a time window;

comparator means; and decision means.

For calculating a performance estimate, in a further embodiment of the invention means are provided for applying PSQM (Perceptual Speech Quality Measure) or PSQM+ (Enhanced Perceptual Speech Quality Measure) techniques to the time aligned input and output signals.

Although in the above time aligning on spurt level has been disclosed, it will be appreciated that it the amount of continuous warping within a spurt is sufficiently small such that PSQM, which operates with spectra over 32 ms, is not affected, the warping effect within the bursts may be ignored.

In practice, the speech signals, which may be test signals, are digitally available, such that the complete processing following the method of the invention and the means specified, may be provided by suitably programmed processor means.

The device according to the invention can be used in or with telecommunications systems wherein speech signals are transmitted or transported in a packet type manner, such as VoIP (Voice over Internet Protocol) systems, ATM (Asynchronous Transfer Mode) systems, and the like. Both, for testing speech coding and decoding (codec) means, as well as transmission properties of a communications system or transmission path used.

The invention will now be described, by way of example only, with reference to the accompanying drawings.

DETAILED DESCRIPTION OF EMBODIMENTS

The invention will now be described and illustrated with reference to exemplary embodiments.

Figure 1:
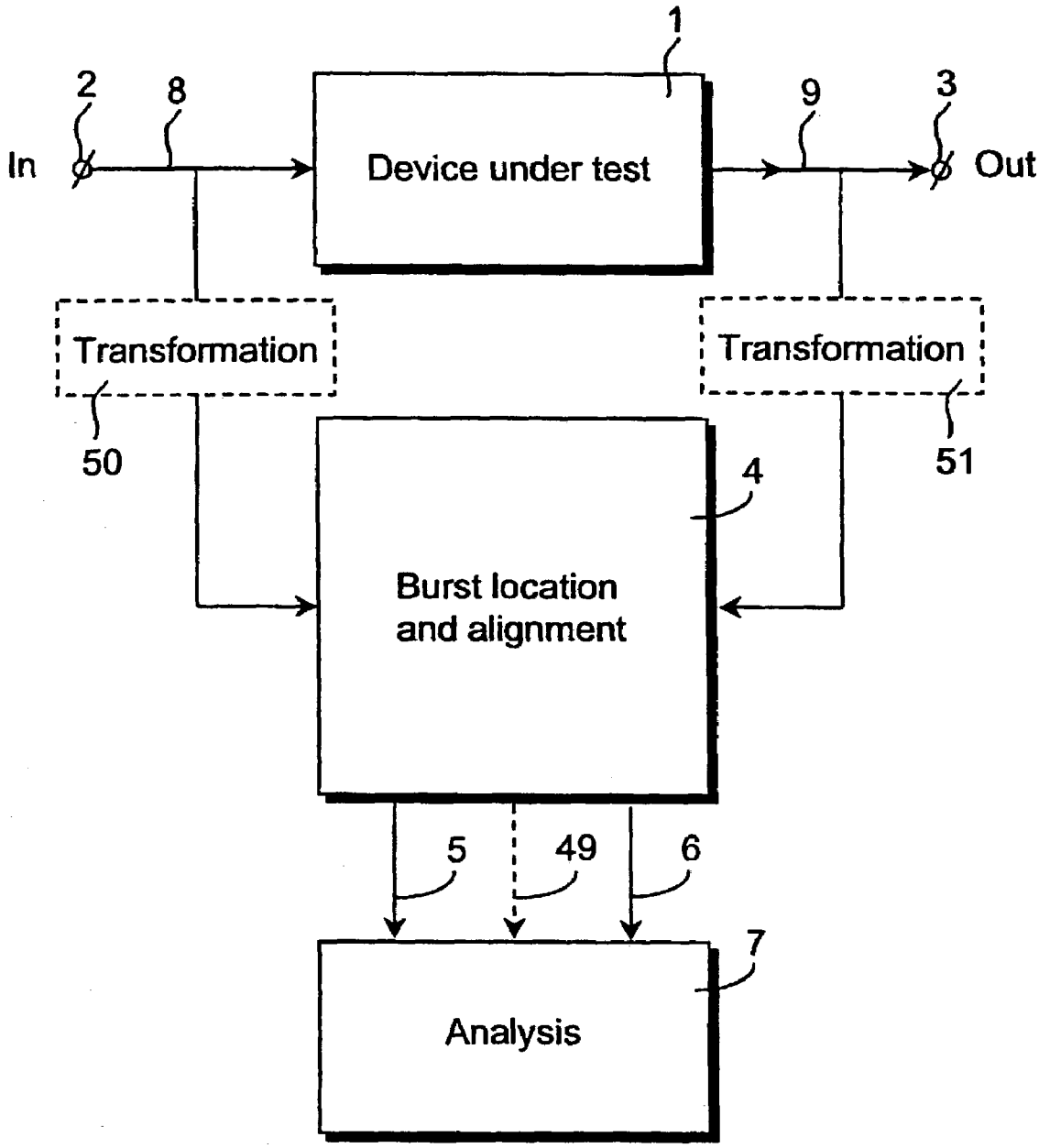
FIG. 1 shows a schematic block diagram of a test system for analyzing speech quality in accordance with the present invention.

In FIG. 1, reference numeral 1 designates a device under test, such as a packet switched communications system like the Internet, a public or private telecommunications network, such as the PSTN (Public Switch Telephone Network) or the ISDN (Integrated Services Digital Network). Known packet switched communication protocols are the so-called Internet Protocol (IP) and the Asynchronous Transfer Mode (ATM), for example. In general, signals are transmitted by the device under test 1 from an input terminal 2 to an output terminal 3, which can be remote from the input terminal 2 if the device under test is a communications system as disclosed above.

It will be appreciated that the device under test 1 can be a complete end-to-end network link or a network link section, for example. Due to different transmission delays of the packets transferred in a packet switched communications system, and by buffering of transmitted packets at the receiving end, silent moments and intervals of a speech signal are lengthened or shortened in time, depending on whether a next speech burst has already been received. For a number of processing steps, such as measuring the quality of speech signals with existing speech quality measurements, in particular perceptual performance estimate methods, these shifts in time need to be undone.

For this purpose, speech burst locating and alignment means 4 are provided, to which both the original or input speech signal 8 and the degraded or distorted output speech signal 9 are applied.

In accordance with the invention, the speech burst locating and alignment means 4 are arranged to locate and time align individual corresponding speech bursts of the output speech signal 9 and the input speech signal 8, providing time aligned input and output signals 5, 6 respectively.

The speech bursts are located following a predefined signal property thereof. In a preferred embodiment of the present invention, the predefined signal property comprises a first parameter representative of an average signal energy content measured in a time window and compared to a threshold, and a second parameter representative of the time duration of the time window applied for providing the first parameter.

For the purpose of the present invention, Root Mean Square (RMS) calculations are applicable, averaged with respect to the duration of the time window.

In the embodiment shown, the aligned input and output speech signals 5, 6 are fed to means 7 for obtaining a performance estimate by applying a perceptual analysis method, such as PSQM (Perceptual Speech Quality Measure) or PSQM+ (Enhanced Perceptual Speech Quality Measure) or others. Reference is made to ITU-T Recommendation P.861, "Objective quality measurement of telephone-band (300–3400 Hz) speech codes" and International Patent Applications: WO 96/06496; WO 96/29850 and WO 96/28953.

The method of determination of the time relation between the input and output speech signals 8, 9 according to the invention will now be illustrated with reference to FIGS. 2*a*, 2*b* and 2*c*.

Figures 2A, 2B, 2C:
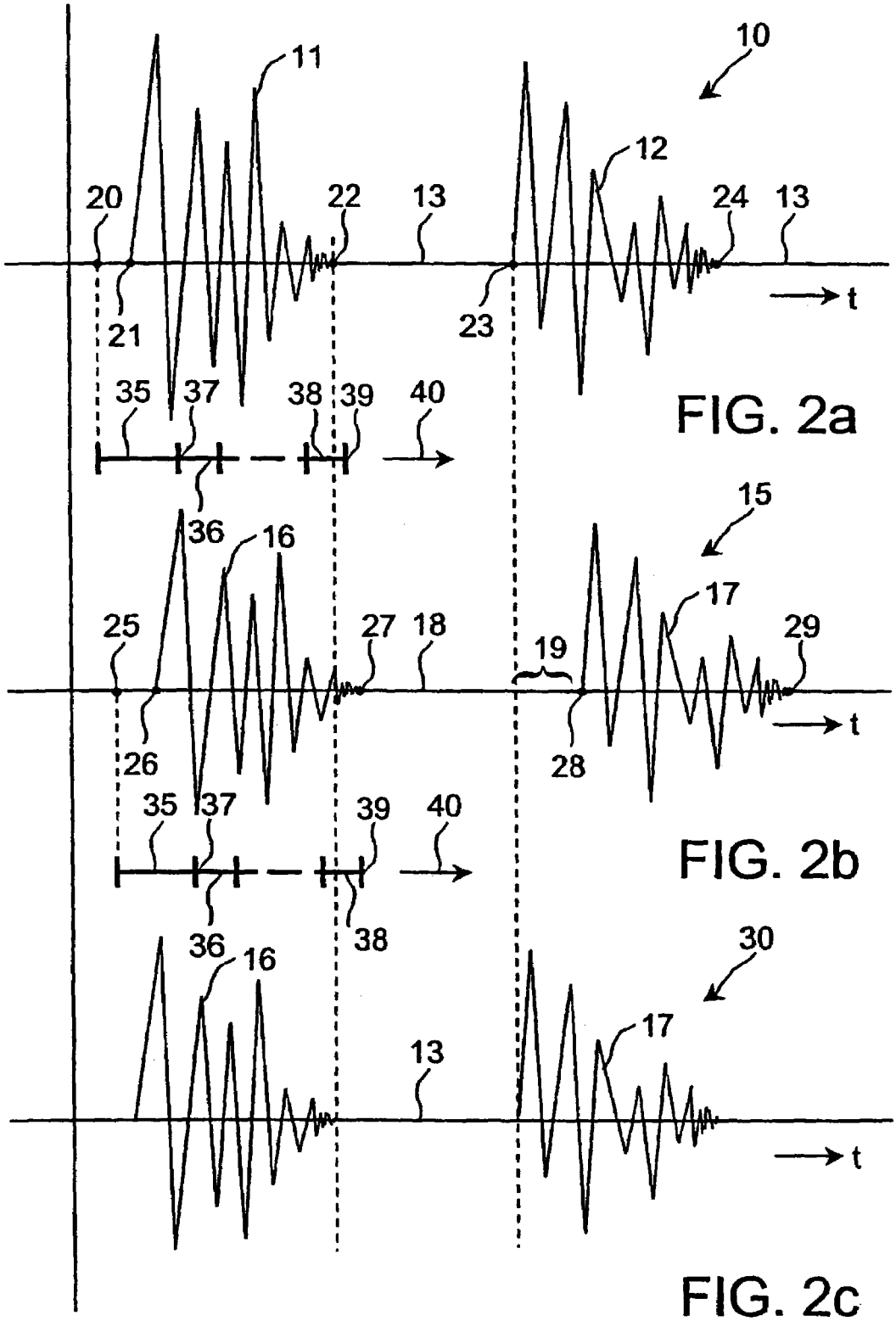
FIGS. 2*a*, 2*b* and 2*c* show a first set of sample waveforms for the purpose of explaining the method according to the invention.

FIG. 2*a* shows an input speech signal 10, comprising a plurality of speech bursts or speech samples, a first 11 and a second 12, which are shown.

FIG. 2*b* shows an output signal 15 after transport of the input signal 10 by the device under test 1 (see FIG. 1) and affected by time warping. In FIG. 2*b*, the first speech burst 16 corresponds to the first speech burst 11 and the second speech burst 17 corresponds to the second speech burst 12 of FIG. 2*a*. The speech bursts 11 and 12 are separated by silence or essentially silence 13. The first speech burst 16 and second speech burst 17 of the output signal 15 are separated by silence or essentially silence 18. Silence or essentially silence is to be understood as a zero signal amplitude or a very low signal energy content over the period of silence 13, 18, i.e. a low signal strength compared to a speech burst or a threshold set, based on the average signal energy content of the speech file or speech signal as a whole.

Due to time warping introduced by the device under test 1, e.g. a VoIP (Voice over Internet Protocol) system, the speech bursts 16, 17 of the output signal 15 suffer a time delay compared to the corresponding speech bursts of the input signal 10, such as the time delay 19 shown in FIG. 2*b*. This time delay also represents silence.

Following the present invention, first global starting points 20, 25 of the input signal 10 and the output signal 15, respectively, are located, by determining a global delay between the speech signals 10, 15 and by measuring energy levels or amplitude levels of the input signal 10 and the output signal 15, for example.

In a further step, starting from the global starting points 20 and 25 of the first speech bursts 11, 16, respectively, in accordance with the novel and inventive concept of the present invention, the speech bursts are selected by locating their stop points 22, 24; 27, 29 and/or start points 21, 23; 26, 28 next to a period of silence or essentially silence 13, 18 between the speech bursts 11, 12 and 16, 17, respectively. Silence or essentially silence 13, 18 is determined from the measured average signal energy content.

By having a pointer (not shown) running along the signals to be processed in a time window in forward direction, an increase of the energy content directs towards encountering a speech burst, i.e. a start point thereof. A decrease in the measured signal energy content has to be evaluated as encountering a period of silence adjacent a speech burst, i.e. next to a stop point of the burst.

For an accurate location of the stop points of the speech bursts in a speech signal, in accordance with a preferred embodiment of the invention, three different parameter settings are applied. That is, different threshold settings and different time durations of the measurement time window.

In the preferred embodiment of the invention, first a relatively wide time window 35 is applied for locating a burst 11, 16. A burst is located if the measured average signal energy content is above a first value of the threshold of the first parameter. Measurements in subsequent adjacent time windows 35, i.e. in the direction of arrow 40, are repeated until a speech burst 11, 16 is encountered.

Once a burst has been located, i.e. its start point 21, 23; 26, 28, from the present location of the time window 35, the time window is set to a smaller value, i.e. time window 36, and the pointer is running from the previous time window 35, preferably from the trailing edge 37 thereof, in the direction of the arrow 40. With this smaller window 36 the measurement of the energy content is repeated for adjacent windows 36, in the direction of the arrow 40, for determining the stop points 22 and 27. The duration of the time window 36 and the threshold are set to such a second time duration and second threshold value, that a considerable amount of the period of silence 13, 18 between the speech bursts 11, 12 and 16, 17 has to be involved before the measured energy content drops below the threshold.

Once the measured signal energy content drops below the second threshold value, indicating a period of silence 13, 18, the time window duration is set to a third time duration 38 and the threshold is set to a third value. The pointer is now running backwards, i.e. against the direction of the arrow 40, preferably from the trailing edge 39 of the present time window 36 located near the stop point 22, 27. The threshold is set to a very low third value, about 1/10 of the second value of the threshold used for determining the stop point in forward direction.

With the time window 38 set to a third time duration equal to or essentially equal to the second time duration and the threshold value set to a small third value, the stop points 22, 27 can be very accurately determined, despite fading out of the speech bursts 11, 16.

Once located, the stop points 22, 27 are combined to correct for time delays in the measurement process itself.

In an embodiment of the invention, only stop points 22, 24; 27, 29 of the speech bursts are located, based on the assumption that the speech bursts itself are not subjected to time warping and that warping only occurs between speech bursts 11, 12; 16, 17.

The measurement process is repeated by starting with the time window 35 and first threshold value from the stop, point, i.e. preferably from an edge of the window 38, in the direction of the arrow 40.

If all the stop points in the input 10 and output signal 15 are thus determined, the time delays 19 are calculated, and the distorted output signal 15 is dewarped, i.e. the corresponding speech bursts 11, 16; 12, 17 are time aligned.

Those skilled in the art will appreciate that the time delay 19 between stop/start points 27, 28 can be calculated using know cross correlation techniques and the like.

FIG. 2*c* shows the time aligned or dewarped output signal 30, in which the time delay 19 is deleted, such that there is no additional time delay between the first and second speech bursts 16, 17 of the aligned output signal 30 compared to the original input signal 10. It will be appreciated that the input and output signal can also be aligned by introducing the time delay 19 in the input signal 10.

On a coarse or sentence level, the speech bursts represent utterances having a relatively high amount of signal energy. On a fine or spurt level, however, it can be shown that the individual speech bursts each are subdivided in shorter bursts. For providing an accurate performance estimate the alignment of corresponding speech burst has to be performed even at spurt level.

Figure 3A:
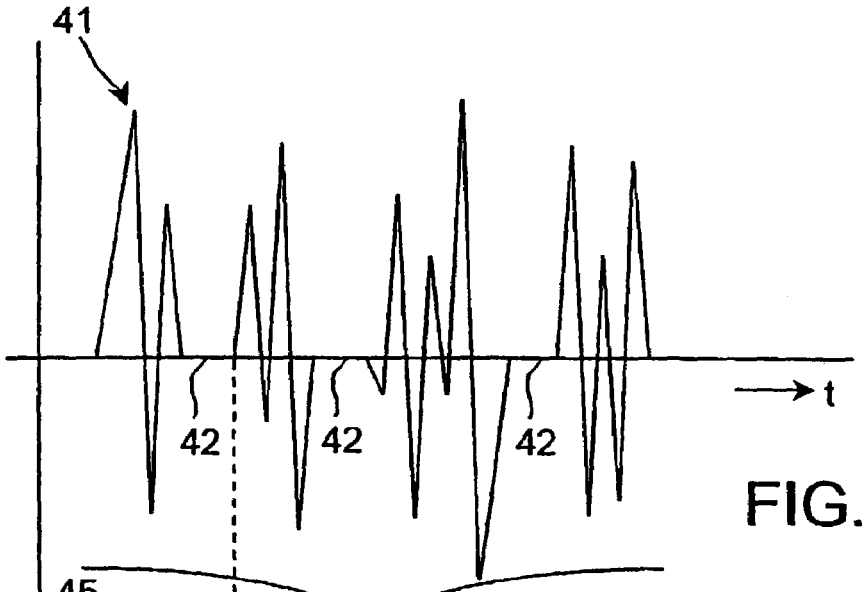
FIGS. 3*a*, 3*b* and 3*c* show a second set of sample wave-forms for the purpose of explaining the method according to the present invention.
Figure 3B:
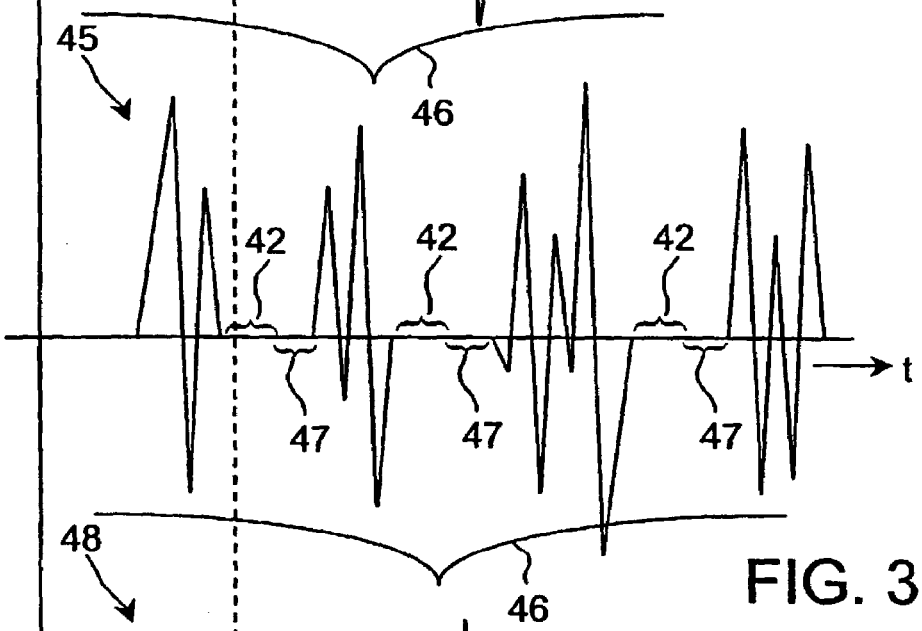

FIGS. 3*a* and 3*b* show a first speech burst 46 of an input signal 41 having short natural moments of silence 42 and an output signal 45 severely affected by time warping, in that in the first speech burst 46 additional periods of silence 47 are introduced. By applying relatively long time windows 35, 36, it will be appreciated that this warping effect on spurt level cannot be detected.

Accordingly, after having applied the steps illustrated above with reference to FIGS. 2*a*, 2*b* and 2*c*, in a preferred embodiment of the invention, the method is repeated using shorter time windows on spurt level compared to sentence level.

Figure 3C:
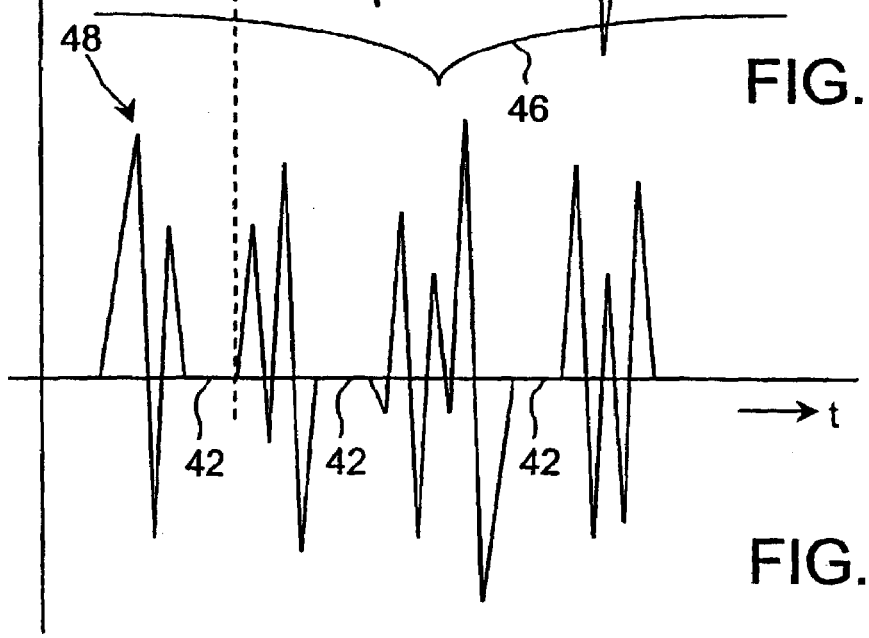

By applying the steps disclosed above to the signals of FIGS. 3*a*, 3*b* with appropriate time window and threshold settings, the additional delays 47 introduced by time warping can be eliminated, as shown in FIG. 3*c* by the aligned output signal 48.

It will be appreciated that, instead of removing the additional delays 47 from the output signal 45, time aligning of the input signal 41 and the output signal 45 can be provided by introducing in the input signal 41 the delays 47.

Typical values of the time window duration and threshold value settings on sentence level are:

first time duration 1 s;
first threshold value 100 (absolute value);
second time duration 200 ms;
second threshold value 100;
third time duration 200 ms;
third threshold value 10.

Typical values of the time window duration and threshold value settings on spurt level are:

first time duration 20 ms;
first threshold value 600;
second time duration 10 ms;
second threshold value 600;
third time duration 10 ms;
third threshold value 100.

Figure 4:
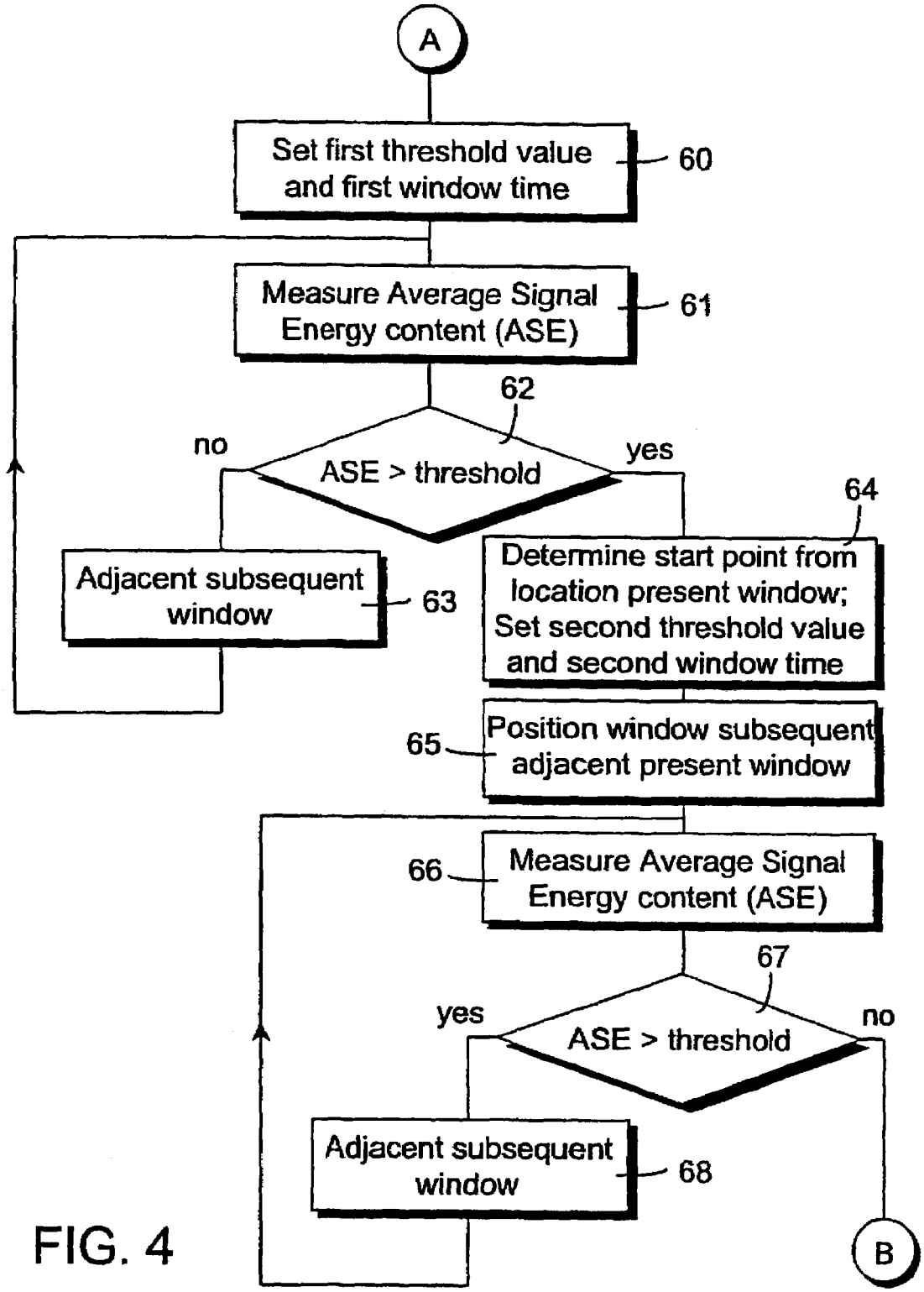
FIG. 4 shows a flow chart of an embodiment of the invention for locating stop points of speech bursts.
Figure 4:
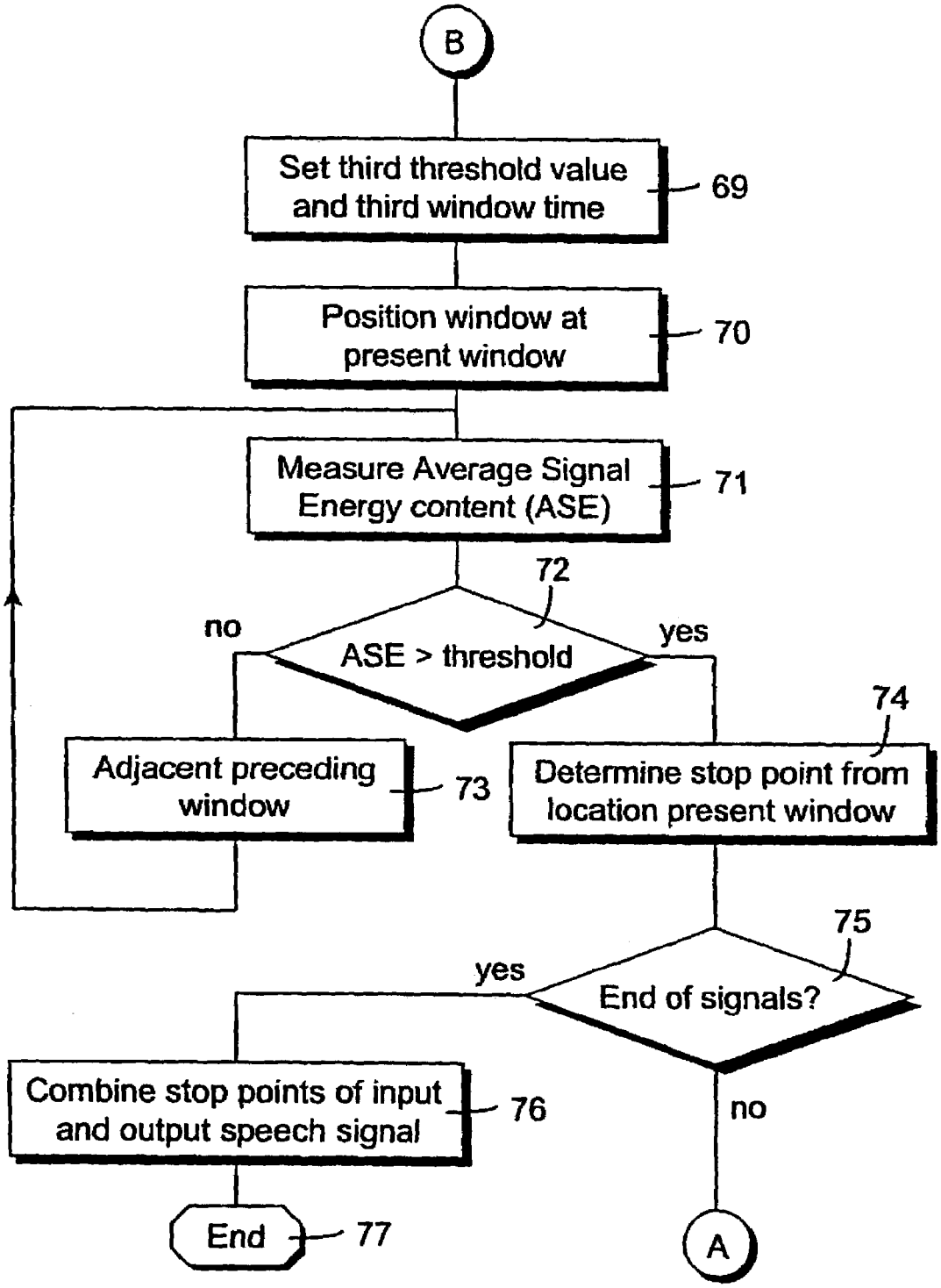

FIG. 4 shows a flow chart diagram for the above disclosed steps for locating a stop point.

Block 60 represents setting of the threshold to the first value and setting of the time window to the first time duration. Measurement of the Average Signal Energy (ASE) content of the speech signal during the time window is indicated by block 61. If the ASE is below the first threshold value, decision block 62, result "no", the ASE measurement is repeated for an adjacent subsequent window, block 63.

However, if the ASE raises above the first threshold value, decision block 62, result "yes", this indicates that a speech burst is encountered, that is a start point thereof, and the threshold is set to a second value and the time window is set to a second time duration, represented by block 64. The next time window is positioned subsequent to and adjacent of the present time window, including a possible overlap of the time windows, as indicated by block 65.

The ASE is measured, block 66, and compared to the threshold of the second value. If the ASE is above the threshold, decision block 67, result "yes", the measurements are repeated for an adjacent subsequent window, block 68.

If the ASE drops below the threshold, decision block 67, result "no", a third threshold value and third time window duration are set, referenced by block 69. The new window is positioned at the present window, block 70 and the ASE is measured, block 71. If the ASE is not above the threshold set, decision block 72, result "no", this indicates that the signal within the current window represents silence or essentially silence, beyond the stop point. Accordingly, the measurement has to be repeated in an adjacent time window, block 73.

If the measured ASE is above the threshold, set to the third value, decision block 72, result "yes", this indicates that the window includes an end portion of the speech signal, i.e. a stop point. Accordingly, the stop point is determined from the present window, block 74. The stop point may be assumed to be positioned in the middle of the time window, for example.

If the end of the input and output signals has not been reached, decision block 75, result "no", the blocks 60–74 are repeated.

At the end of the signals, decision block 75, result "yes", the stop points of the corresponding bursts of the input and output speech signals are combined, block 76, and the process stops, block 77.

For speech quality analyses, a complete compensation or cancellation of the time delays 19, 47 is not always required, in which cases the measured time delays 19, 47 can be introduced as an extra "penalty" with regard to the determined speech quality of the device under test 1, for example. In FIG. 1 this additional penalty is illustrated by arrow 49, shown in broken lines.

For a very accurate measurement of the time delays 19, 47 the start points 21, 26; 23, 28 of the speech bursts may have to be precisely located too.

The start points 21, 23; 26, 28 of the speech burst 11, 12 and 16, 17 respectively, can be more accurately found with essentially the same steps as applied for location of the stop points 22, 24; 27, 29.

That is, in a first step, starting from the global starting points 20. 25 of the input signal 10 and the output signal 15, respectively, a pointer is running along the signals, measuring the average signal energy content in a relatively wide time window, such as the time window 35, set to a fourth time duration. The measured average signal energy content is compared to a threshold set to a fourth value. Measurement in subsequent adjacent time windows 35, i.e. in the direction of the arrow 40, are repeated until a speech burst 11, 16 is encountered. That is, if the measured average signal energy content in a respective time window is above the threshold set to the fourth value.

Once a burst has been located, the time window is set to a smaller fifth value, such as the time window 36, and the pointer is running backwardly, i.e. against the direction of the arrow 40, preferably from the leading edge 37 of the present time window 35. With this smaller window 36, the measurement of the energy content is repeated for adjacent windows 36 against the direction of the arrow 40. The fifth duration of the time window and the fifth value of the threshold are set such that a considerable amount of the period of silence adjacent the start points 21, 23; 26, 28 has to be involved before the measured energy content drops below the threshold.

If the measured signal energy content drops below the threshold value set, the time window duration is set to a sixth time duration, essentially equal to the fifth time duration, and the threshold is set to a sixth value, essentially lower than the fifth value. The pointer is still running backwards, i.e. against the direction of the arrow 40, from the same position as the present time window. A start point is detected once the measured average energy content in the time window drops below the sixth value of the threshold.

Figure 5:
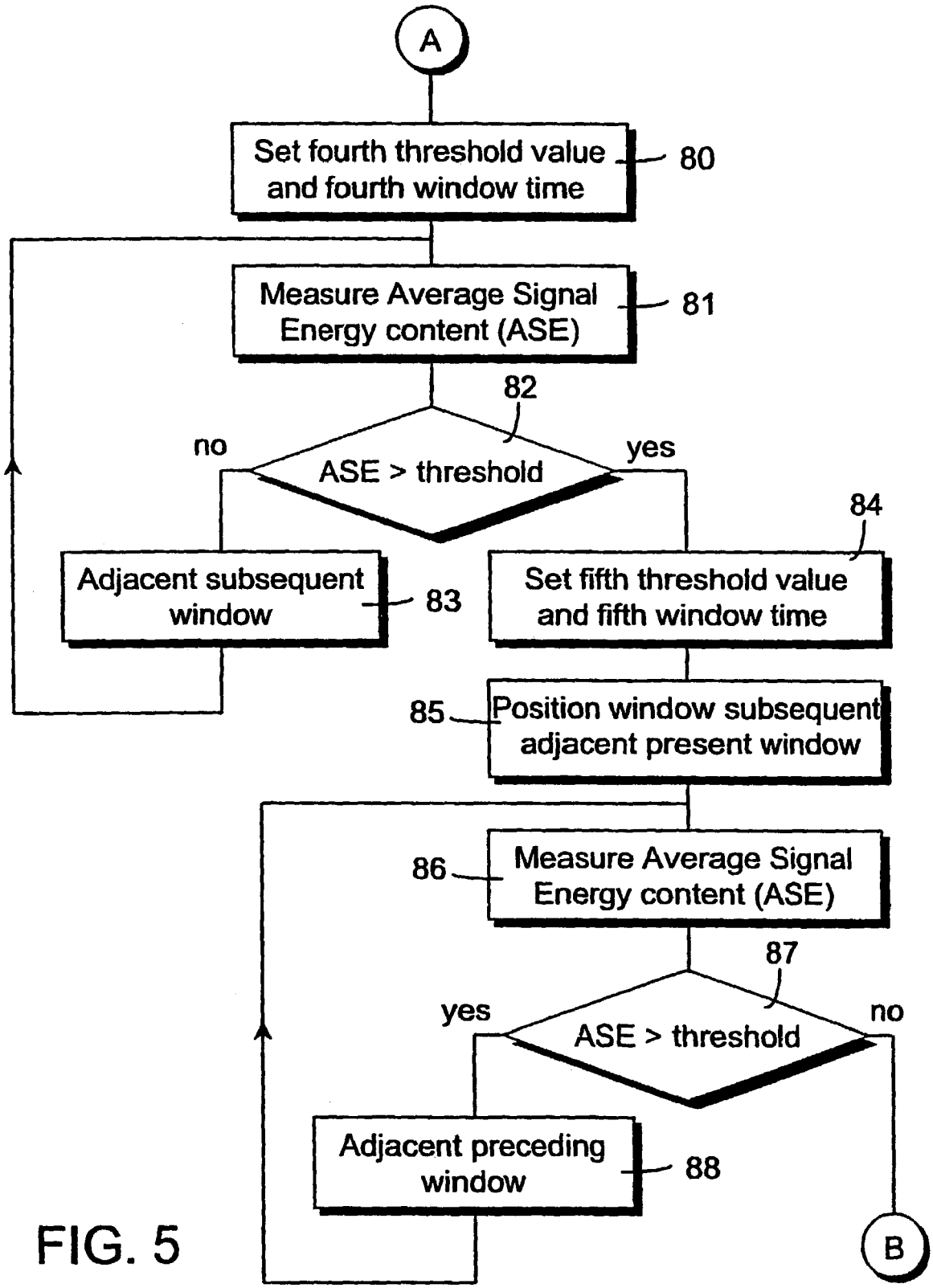
FIG. 5 shows a flow chart of an embodiment of the invention for locating start points of speech bursts.
Figure 5:
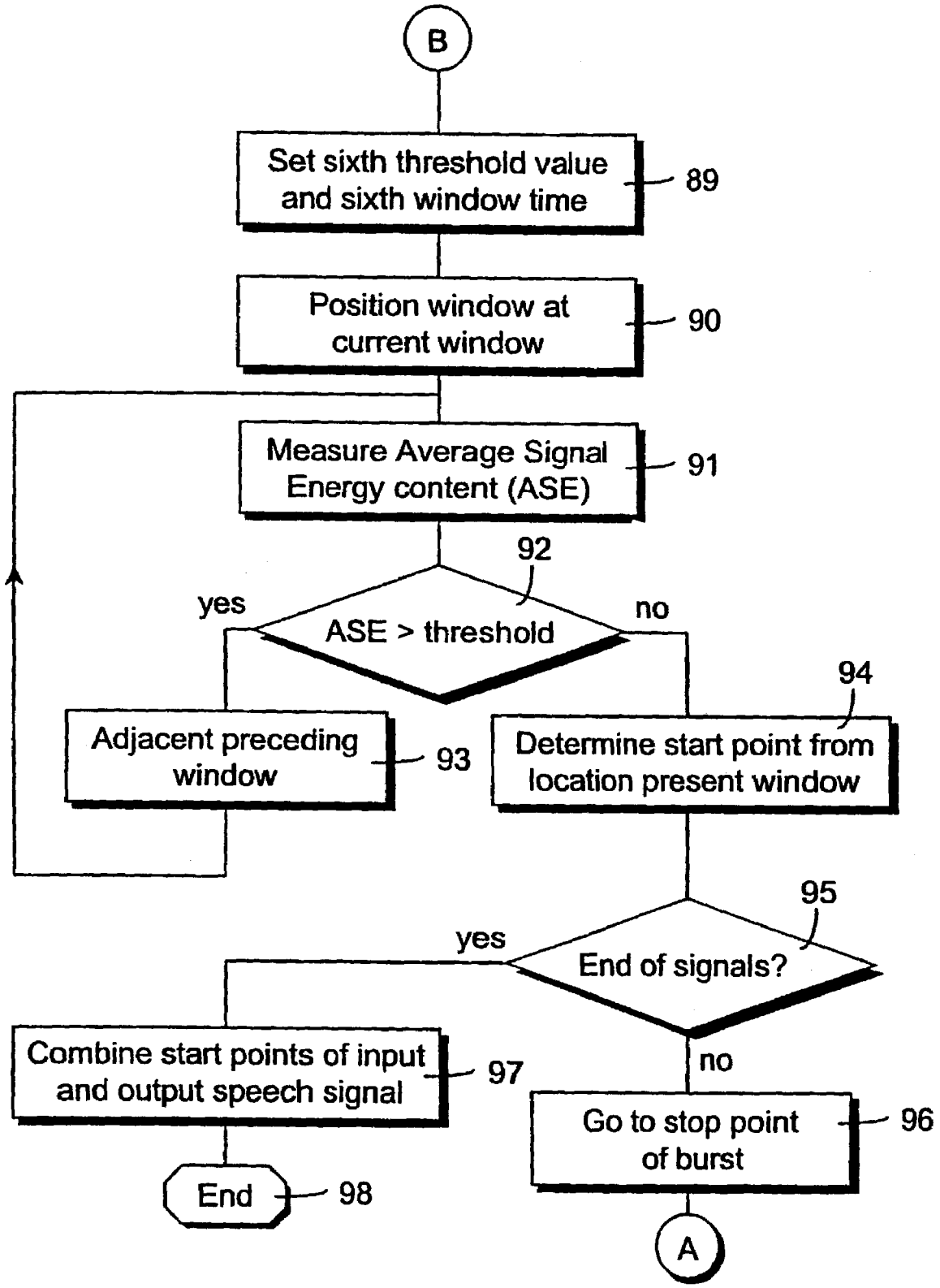

The steps for locating the start points in the above disclosed embodiment of the invention, are also shown in the flow chart diagram of FIG. 5.

Block 80 indicates setting of the threshold to its fourth value and the time window to a fourth time duration. Next the ASE is measured, block 81, and compared against the threshold, decision block 82.

If the ASE is below the threshold, decision block 82 result "no", the measurements are repeated in an adjacent subsequent window, block 83, because no speech burst has been encountered.

However, if the ASE is above the threshold, decision block 82, result "yes" a fifth threshold value and fifth window time duration are set, block 84, and the window is positioned subsequent and adjacent to the present window, as referred by block 85. The new window can be set to overlap the present window.

The step of measuring the ASE is repeated, block 86, and the measured ASE is compared to the threshold, decision block 87.

If the ASE is above the threshold, decision block 87, result "yes", the measurement is repeated in an adjacent preceding window, block 88.

If the ASE drops below the threshold, decision block 87, result "no", the conclusion can be drawn that the time window has moved backwards beyond the start point. For a more accurate determination of the start point, the threshold is set to the sixth value and the time window to the sixth tine duration, indicated by block 89. The new time window is positioned at the current window, block 90, and the ASE is measured, block 91.

If the ASE is above the threshold, decision block 92, result "yes", the conclusion may be drawn that the window still includes a large signal portion of the speech burst and that the measurement has to be repeated in an adjacent preceding window, block 93.

If the ASE drops below the threshold, decision block 92, result "no", it may be concluded that the time window is moved, for the greater part, beyond the start point, such that from the current location of the window the start point can be determined, for example from the middle of the window, by block 94.

The measurements are repeated till the end of the input and output signals, decision block 95, result "no", in each case starting from the stop point of the respective burst, block 96.

Once the signals have been completely processed, decision block 95, result "yes", the start points of the corresponding speech burst of the input and output speech signals are combined, block 97, and the process stops, block 98.

The fourth, fifth and sixth threshold values as well as the fourth, fifth and sixth time durations of the time windows may be set to the same values as applied for determining the stop points, disclosed above.

Those skilled in the art will appreciate that actual settings may differ, both in absolute and relative sense.

It will be understood that parts of the signals 10, 15 between adjacent start and stop points representing silence or essentially silence can be manipulated for processing purposes, if required.

Those skilled in the art will appreciate that the input signal 10, 41 and the output signal 15, 45 of which the time relation is determined according to the present invention, can be signals on which a signal transformation step has been performed, such as filtering or the like. In the case of speech signals, frequency components below 300 Hz may be suppressed, which frequency components have a large dynamic range which exceeds their expected contribution to the loudness. The start and stop points can be searched for in the transformed versions of the input and output signal, whereas compensation of the determined delays or time relationship between the transformed signals may be likewise applied to the non-transformed input and/or output signals. In FIG. 1, transformation means 50, 51 are schematically shown with broken lines.

By applying a suitable transformation of the input and output signals 8, 9 before feeding thereof to the speech burst locating and alignment means 4, the resolution of the determination of the start and stop points can be enhanced.

Figure 6:
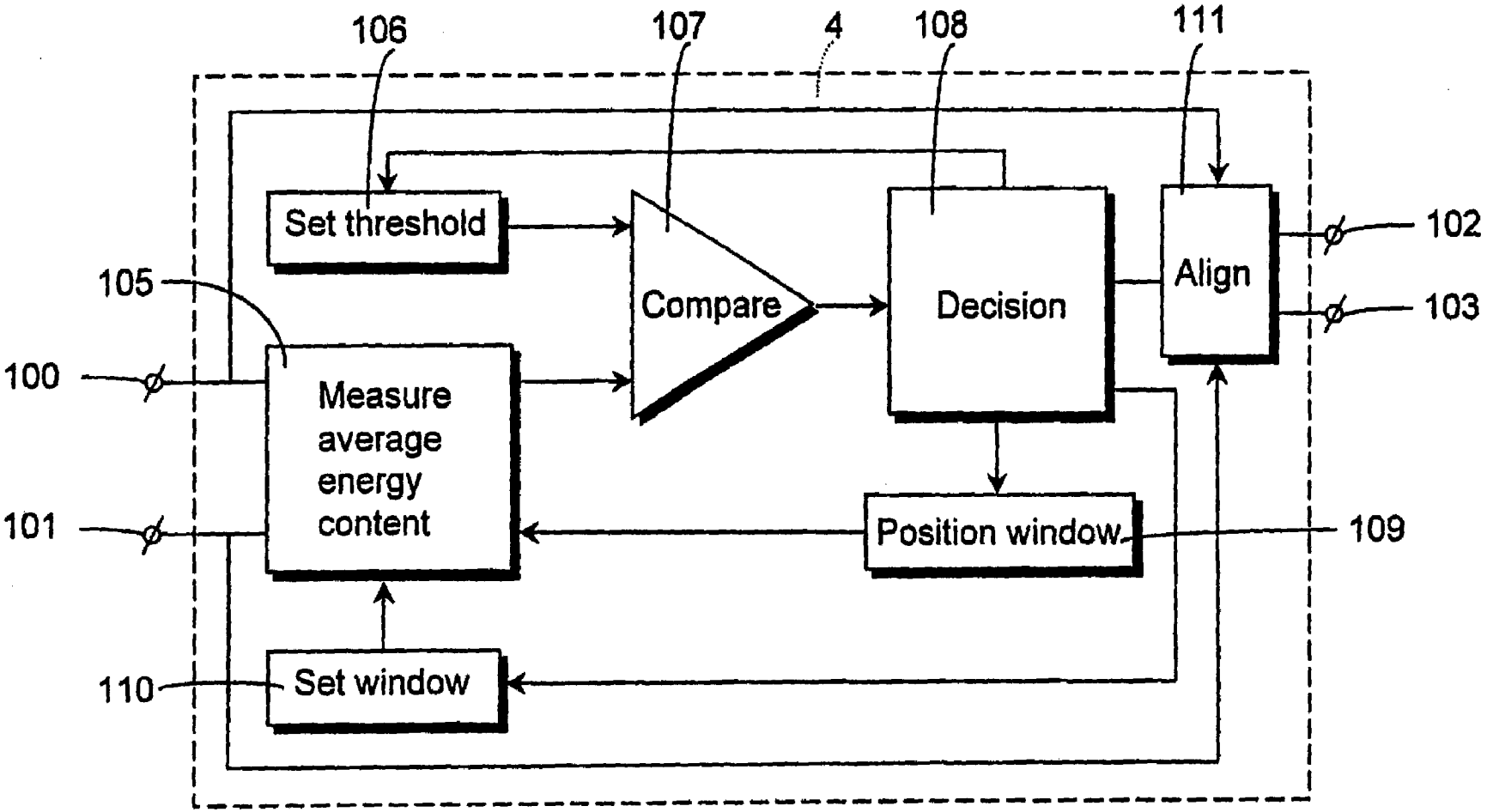
FIG. 6 shows a more detailed block diagram of the burst location and alignment means shown in FIG. 1.

FIG. 6 shows in more detailed the burst location and alignment means 4 of FIG. 1.

The speech signals of which the time relation has to be determined are applied to means 105 for measuring the average energy content via input terminals 100, 101. The time window within which the average energy content has to be measured is set by means 110, essentially comprising a pointer moving along the speech signals during a specific time duration. The position of the pointer with respect to the signals is determined by means 109. That is, the means 109 determine part of the speech signals over which the cursor runs, i.e. in forward or backward direction of the signals. In the embodiment shown, both the means 109 and 110 provide control signals to the means 105 for measuring the average energy content.

The measured average energy content is compared by comparator means 107 to a threshold set by means 106.

The output of the comparator means 107 is fed to decision means 108 which control the means 106 for setting the threshold, the means 110 for setting the time window duration and the means 109 for positioning the time window with respect to the speech signals, in accordance with the method of the invention for locating start and/or stop points of speech bursts, as disclosed above.

The decision means 108 further control means 111 for time aligning of the speech signals applied to the input terminals 100, 101, resulting in time aligned speech signals at output terminals 102, 103.

Those skilled in the art will appreciate that the burst location and alignment means 4 can be implemented by suitably programmed processor means.

With the method according to the invention, continuous and discontinuous dewarping is achieved by individually locating speech bursts of both a distorted or affected output signal and its original or input signal. By performing the process on a sentence and spurt level, a very accurate alignment of corresponding speech burst can be achieved for generating a performance estimate by comparing corresponding speech burst using perceptual analysing techniques.

The invention claimed is:

1. A method of determining the time relation between an original or input speech signal and an output speech signal affected by time warping in a communications system, such as a VoIP (Voice over Internet Protocol) system, by time aligning corresponding speech bursts of said output speech signal and said original or input speech signal, wherein corresponding speech bursts of said input and output speech signal are located in accordance with a predefined signal property thereof.

2. A method of determining the time relation between an original or input speech signal and an output speech signal affected by time warping in a communications system, such as a VoIP (Voice over Internet Protocol) system, by time aligning corresponding speech bursts of said output speech signal and said original or input speech signal, wherein corresponding speech bursts of said input and output speech signal are located in accordance with a predefined signal property thereof; and wherein said predefined signal property comprises a first parameter representative of an average signal energy content of a speech burst compared to a threshold, and a second parameter representative of a time window duration during which said energy content is being measured.

3. A method according to claim 2, wherein said threshold and said duration of said time window are varied for optimally locating a speech burst of said input and output speech signal, dependent on the average signal energy content measured.

4. A method according to claim 3, wherein said threshold and said duration of said time window are selected for determining silence or essentially silence adjacent to a speech burst.

5. A method according to claim 4, wherein corresponding speech bursts of said input and output signal are located in a first step on a coarse or sentence level and in a second step on a fine or spurt level.

6. A method according to claim 5, wherein during said first step said threshold is set to a smaller value compared to said threshold during said second step, and said duration of said time window is set to a larger value compared to said duration of said time window during said second step.

7. A method according to claim 5, wherein successive stop points of speech bursts are located on sentence level by performing the steps of:

a) setting the threshold to a first value and the time window to a first time duration, b) measuring the average signal energy content in a time window of the first time duration and comparing same to the threshold of the first value, c) repeating the measuring of the average signal energy content and comparison to the threshold of the first value in an adjacent subsequent time window of the first time duration while the measured energy content is below the threshold of the first value, and if the measured energy content is above the threshold of the first value, marking the location of the time window of the first time duration as a start point of the respective speech burst, d) setting the threshold to a second value typically equal to the first value and the time window to a second time duration typically less than the first time duration if the measured energy content is above the threshold of the first value, e) measuring the average signal energy content in a time window of the second duration, essentially located subsequently adjacent the time window of the first duration resulting from step d), and comparing same to the threshold of the second value, f) repeating measuring of the average signal energy content and comparison to the threshold of the second value in an adjacent subsequent time window of the second time duration while the measured energy content is above the threshold of the second value, g) setting the threshold to a third value typically less than the second value and the time window to a third time duration typically equal to the second time duration if the measured energy content is below the threshold of the second value, h) measuring the average signal energy content in the time window of the third value essentially located at the time window of the second duration resulting from step g) and comparing same to the threshold of the third value, i) repeating measuring of the average signal energy content and comparison to the threshold of the third value in an adjacent preceding time window of the third duration while the measured energy content is below the threshold of the third value, j) determining a stop point of a speech burst from the location of the time window in step i) if the measured energy content is above the threshold of the third value, and k) repeating steps a)–j) until the end of the speech signal.

8. A method according to claim 7, wherein in step g) said time window is set to a third value less than said second time duration and said time window in step h) is initially located at or near an end portion of said time window of said second duration of step g).

9. A method according to claim 7, wherein said stop points of corresponding speech bursts of said input and output signals are combined and time delays are determined between subsequent combined stop points on the basis of which said speech bursts of said output signal are time dewarped.

10. A method according to claim 7, wherein stop points of speech bursts are located on spurt level by repeating said steps a)–k) for different first, second and third values of said threshold and different first, second and third time durations of said time window.

11. A method according to claim 10, wherein said first, second and third values of said threshold for allocating stop points on said spurt level are set to a higher value compared to said first, second and third values for allocating stop points on said sentence level, and wherein said first, second and third time durations of said time window for allocating stop points on said spurt level are essentially less than said first, second and third time durations of said time window for allocating stop points on said sentence level.

12. A method according to claim 7, wherein successive start points of speech bursts are located on sentence level by performing the steps of:

m) setting the threshold to a fourth value and the time window to a fourth time duration, n) measuring the average signal energy content in a time window of the fourth time duration and comparing same to the threshold of the fourth value, o) repeating measuring of the average signal energy content and comparison to the threshold of the fourth value in an adjacent subsequent time window of the fourth time duration while the measured energy content is below the threshold of the fourth value, p) setting the threshold to a fifth value typically equal to the fourth value and the time window to a fifth time duration typically less than the fourth time duration if the measured energy content is above the threshold of the fourth value, q) measuring the average signal energy content in the time window of the fifth value essentially located subsequently adjacent the time window of the fourth duration resulting from step p) and comparing same to the threshold of the fifth value, r) repeating measuring of the average signal energy content and comparison to the threshold of the fifth value in an adjacent preceding time window of the fifth time duration while the measured energy content is above the threshold of the fifth value, s) setting the threshold to a sixth value typically less than the fifth value and the time window to a sixth time duration typically equal to the fifth time duration if the measured energy content is below the threshold of the fifth value, t) measuring the average signal energy content in the time window of the sixth value essentially located at the time window of the fifth duration resulting from step s) and comparing same to the threshold of the sixth value, u) repeating measuring of the average signal energy content and comparison to the threshold of the sixth value in an adjacent preceding time window of the sixth duration while the measured energy content is above the threshold of the sixth value, v) determining a start point of a speech burst from the location of the time window in step u) if the measured energy content is below the threshold of the sixth value, and w) repeating steps m)–v) each time from a stop point of a speech burst until the end of the speech signal.

13. A method according to claim 12, wherein start points of speech bursts are located on spurt level by repeating steps m)–w) for different fourth, fifth and sixth values of said threshold and different fourth, fifth and sixth time durations of said time window.

14. A method according to claim 13, wherein said fourth, fifth and sixth values of said threshold for allocating start points on said spurt level are set to a higher value compared to said fourth, fifth and sixth values for allocating stop points on said sentence level, and wherein said fourth, fifth and sixth time durations of said time window for allocating start points on said spurt level are essentially less than said fourth, fifth and sixth time durations of said time window for allocating start points on sentence level.

15. A method according to claim 1, wherein a performance estimate is generated by comparing speech bursts of said input and output speech signals applying cross-correlation techniques and PSQM (Perceptual Speech Quality Measure) or PSQM+ (Enhanced Perceptual Speech Quality Measure) techniques.

16. A device for determining the time relation between an original or input speech signal and an output speech signal affected by time warping in a communications system, such as a VoIP (Voice over Internet Protocol) system, comprising means for locating corresponding speech bursts of said input and output speech signal in accordance with a predefined signal property thereof, and means for time aligning corresponding speech bursts.

17. A device for determining the time relation between an original or input speech signal and an output speech signal affected by time warping in a communications system, such as a VoIP (Voice over Internet Protocol) system, comprising means for locating corresponding speech bursts of said input and output speech signal in accordance with a predefined signal property thereof, and means for time aligning corresponding speech bursts;

wherein said means for locating said speech bursts are arranged for determining a first parameter representative of a measured average signal energy content of a speech burst compared to a threshold value and a second parameter representative of a time window duration during which said energy content is being measured.

18. A device according to claim 17, wherein said means for locating said speech bursts are arranged for varying said threshold value and said time window duration.

19. A device according to claim 18, wherein said means for locating said speech bursts comprise:

means for setting a threshold;

means for setting a time window duration;

means for positioning said time window;

means for measuring average signal energy content in said time window;

comparator means, and decision means.

20. A device according to claim 18, wherein said means for locating corresponding speech bursts of said input and output signal are arranged for locating said speech bursts in a first step on a coarse or sentence level and in a second step on a fine or spurt level.

21. A device according to claim 16, comprising means for generating a performance estimate from time aligned signals, in particular arranged for applying cross-correlation techniques and PSQM (Perceptual Speech Quality Measure) or PSQM+ (Enhanced Perceptual Speech Quality Measure) techniques.

22. A device according to claim 16, wherein said means are comprised of processor means.

23. A telecommunications system, such as a VoIP (Voice over Internet Protocol) system, comprising a device according to claim 16.

* * * * *